United States Patent [19]

Hasegawa et al.

[11] 3,953,210

[45] Apr. 27, 1976

[54] DRY WORKING PHOTOGRAPHIC PROCESS RELATING TO N-VINYL COMPOUND SYSTEM

[75] Inventors: Katsue Hasegawa; Reiji Sano; Shirow Askawa; Shunsuke Matsuda, all of Kawasaki, Japan

[73] Assignee: Matsushita Electric Industrial Company Limited, Osaka, Japan

[22] Filed: July 23, 1974

[21] Appl. No.: 490,925

Related U.S. Application Data

[63] Continuation-in-part of Ser. No. 319,605, Dec. 29, 1972, abandoned.

[30] Foreign Application Priority Data

Dec. 28, 1971 Japan ..... 47-114

[52] U.S. Cl. ..... 96/45.2; 96/41; 96/42; 96/43; 96/48 HD; 96/90 R; 354/6; 346/110 R; 355/20

[51] Int. Cl.² ..... G03C 5/32; G03C 5/24; G03C 1/52

[58] Field of Search ..... 96/45.2, 48 HD, 90 R, 96/41, 42, 43; 354/6; 355/20; 346/110

[56] References Cited

UNITED STATES PATENTS

| | | | |
|---|---|---|---|
| 2,944,897 | 7/1960 | Shirk | 96/41 |
| 3,042,518 | 7/1962 | Wainer | 96/48 HD |
| 3,476,562 | 11/1969 | Yamada et al. | 96/90 R |
| 3,503,745 | 3/1970 | Yamada et al. | 96/90 R |
| 3,607,266 | 9/1971 | Yamada et al. | 96/90 R |
| 3,620,748 | 11/1971 | Fichter | 96/48 HD |
| 3,624,228 | 11/1971 | Fotland | 96/90 R |
| 3,658,533 | 4/1972 | Fotland et al. | 96/90 R |
| 3,697,276 | 10/1972 | Lewis et al. | 96/90 R |
| 3,741,651 | 6/1973 | Nishiyama et al. | 355/20 |

*Primary Examiner*—Jack P. Brammer

[57] ABSTRACT

A film coated with a dispersion of an N-vinyl compound, an organic halogen compound and a sensitizer in gelatin is preheated at 60°–120°C before an imagewise exposure to sensitize the film and to destroy fog-nuclei. After the imagewise exposure the film is subjected to a red light flood exposure for intensifying latent image, heating for development and flood light exposure for fixing to give a negative image of high contrast. The preheating may be applied to a film once exposed to extinguish the resulting latent image and thereby to be subjected to another exposure.

7 Claims, 12 Drawing Figures

DRY WORKING PHOTOGRAPHIC PROCESS RELATING TO N-VINYL COMPOUND SYSTEM

This application is a continuation-in-part of our application Ser. No. 319,605 filed Dec. 29, 1972 now abandoned.

The present invention relates generally to a dry working photographic process, and more particularly to an improved process of producing a fog-free and sharply defined image on a film coated with a hydrophilic dispersion of a photosensitive composition comprising an N-vinyl compound, an organic halogen compound and a sensitizer, which process is especially suitable for recording an image displayed on a cathode ray tube.

Various non-silver photosensitive compositions of dry working type are known. U.S. Pat. Nos. 3,476,562 and 3,607,266 both issued to Yamada et al, for example, describe a group of compositions essentially consisting of a combination of an N-vinyl compound and an organic halogen compound capable of liberating a free radical, which combination is dispersed in a hydrophilic-film-forming vehicle in discrete particle form.

The above composition features that a color-producing reaction occurs when the composition is exposed to a strong light preferably followed by heating and that the N-vinyl compound are caused to polymerize to give a colorless polymer by exposure to a weak light which may be followed by heating. The color-producing reaction can be promoted by exposure to red light subsequently to the strong light irradiation and/or incorporation of a suitable sensitizer. Due to such characteristics, the composition can be processed for producing either a positive or a negative image by arrangement of the sequence of exposure and heating procedures and employment of appropriate exposure conditions.

Both the positive and negative-working processes for this composition are described, for example, in U.S. Pat. Nos. 3,476,562; 3,607,266 and 3,697,276.

Figure 1:
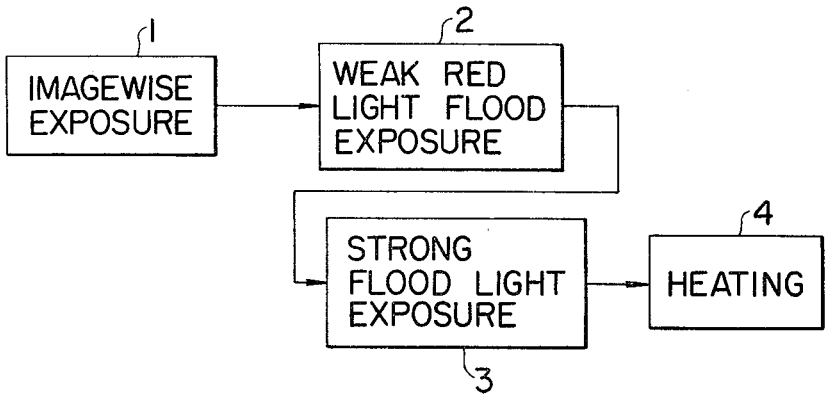
FIG. 1 PRIOR ART
FIGS. 1 and 2 are diagrams showing prior art positive-working and negative-working photographic processes, respectively.

A prior art positive-working photographical process generally includes four steps 1–4 of FIG. 1. A photosensitive material such as a film is initially exposed imagewisely usually to UV light at the step 1 to cause the light-struck areas to polymerize. The flood or blanket exposure at the step 2 to weak, e.g., 0.5 mW/cm$^2$ for 2 sec, red light promotes the polymerization and sensitizes the non-light struck areas. The subsequent strong, e.g. 100 mW/cm$^2$ for 3 sec, flood light exposure to usually white light at the step 3 and the heating at the step 4 cause a color-producing reaction to occur in the non-light-struck areas.

Figure 2:
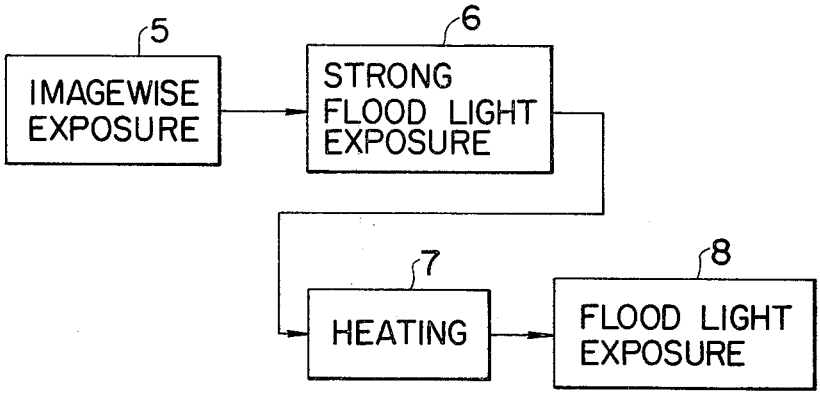
FIG. 2 PRIOR ART

For producing a negative image a process of FIG. 2 is employed. The initial step 5 of an imagewise exposure usually to strong UV light causes latent images to be formed in the light-struck areas and at the same time the non-light-struck areas or more accurately weakly light-struck areas to commence to polymerize. The latent images are intensified by the flood exposure to red light at the step 6 and are developed by heating at 7. The polymerization is preferably completed by the second flood exposure usually to UV light at the step 8.

Optical density of the final image produced by the process of FIG. 1 depends on the intensity of the second blanket exposure at the step 3. In the case of FIG. 2 the density greatly depends on the intensity of the flood exposure of the step 6. These exposure must be increased to obtain images of higher density. On the other hand, a complete polymerization of the N-vinyl compound in areas to turn into background areas of the produced images is required to give images of good contrast. Every exposure, however, for the sake of color-producing reaction inevitably causes such a reaction to occur also in the undesired areas to some extent, resulting in yielding of fog therein, which means loss of the contrast. For example, a reflection density of 0.75 was observed in the background of a picture produced by the process of FIG. 1 while the colored areas showed a maximum value of 1.45. Such unfavorable coloring of the background may be prevented to certain extent by employment of low intensity light sources for flood exposures, but the measure requires a prolonged overall processing time and the effect thereof is not fully satisfactory.

Accordingly it is an object of the present invention to provide an improved dry working photographical process which gives a fog-free and sharply defined image.

It is another object of the invention to provide such an improved process suitable for recording an image produced on a cathode ray tube.

It is still another object of the invention to provide a dry working photographic process which allows a film to be subjected to a multiplicity of imagewise exposures until a desired image is finally projected thereon and to be developed thereafter to give only the last image.

A photosensitive composition for use in a process of the invention is a known one comprising at least one N-vinyl compound, at least one organic halogen compound in which at least three halogen atoms are attached to a single carbon atom and a sensitizer. A combination of N-vinylcarbazole, carbon tetrabromide and 4-(p-dimethylaminostyryl)-quinoline is preferred. The composition is dispersed in discrete fine particle form in a water soluble dispersion medium or solid-film-forming vehicle such as gelatin, gums or polyvinyl alcohol. The dispersion or emulsion is applied onto a support such as paper, synthetic resin film, glass plate or metallic plate followed by drying. (A support coated with the dry emulsion layer will be hereinafter called a film for brevity.)

Figure 3:
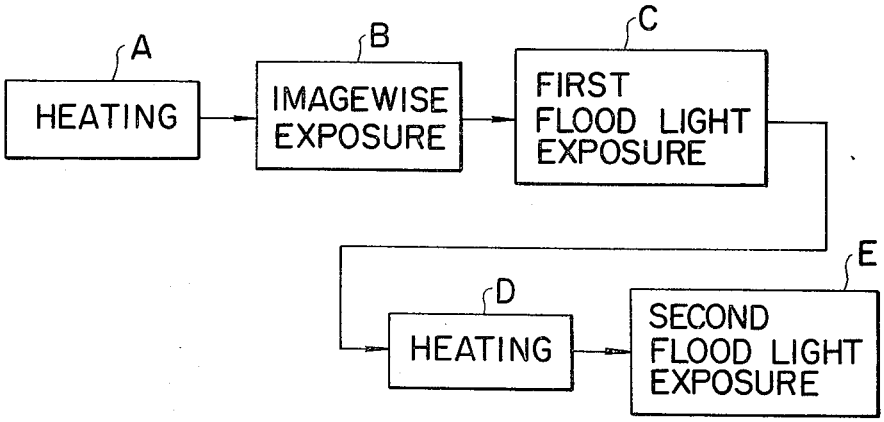
FIG. 3 is a diagram showing a negative-working photographic process according to the invention.

In brief, a photographic process for producing a negative image comprises five steps in a sequence as shown in FIG. 3 by steps designated A, B, C, D and E, respectively. At the first step A, a dry film is preheated at a temperature of 60° to 120° C for 1 to 60 seconds. After the second step B of the usual imagewise exposure, the film is subjected to a first flood light or blanket exposure at the third step C to red light in the wavelength range of 5000 to 7000 A at a power density of 1.0 to 1000 mW/cm². The film is then heated at 60° to 120° C at the step D and thereafter is subjected to a second flood light exposure to visible light at an illumination intensity of 50 to 500 lux for at least 1 second at the final step E. trace A brief description of the dispersed phase of the composition will be presented prior to detailed description of the above five steps. X-ray diffraction pattern of powdered N-vinylcarbazole was observed in a depressed manner even when the emulsion layer on the film was subjected to observation, while no pattern either characteristic of carbon tetrabromide or indicative of any new composition was observed. Carbon tetrabromide, which is of monoclinic or cubic symmetry in the crystal state, is considered to lose its crystal structure when dispersed in gelatin. On the other hand, fine particles were observed under a microscope in the emulsion layer on the film, the diameter thereof was distributed around a few microns. These particles seemed to rotate a polarized light. Accordingly, it may be allowed to consider that N-vinylcarbazole is in the form of fine particles partially covered with corpuscular carbon tetrabromide in the dispersion medium such as gelatin.

Referring again to FIG. 3, the steps A, C and E form an essential portion of the invention. The remainder steps B and D are substantially identical with the prior art procedures for an imagewise exposure and development heating, respectively.

In particular, the preheating step A is the most important feature of the invention. The preheating has remarkable effects on sensitization of the film, reviving a deteriorated film, and reduction of the background density or production of a picture of good contrast. It should be noted that the preheating causes such advantageous effects only when applied to a completely dry film. It is an independent procedure utterly different from the usual drying of the emulsion-wet film by heating. It is also necessary to cool the dried film once to room temperature before the preheating step A. Further description concerning the nature of the preheating will be given hereinafter.

A light source for the imagewise exposure of the step B is preferably in the wavelength range of 2500 to 5000 A.

Figure 4:
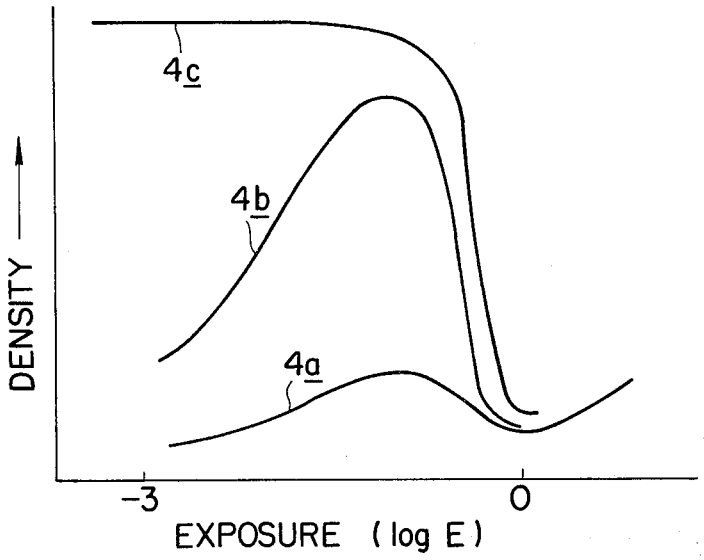
FIG. 4 is a characteristic curve of a photosensitive composition as treated in the process of FIG. 3.

In the step C, total exposure energy and the light intensity should be within a predetermined range to obtain a picture of good contrast. FIG. 4 is a graph showing the effects of the flood exposure on the contrast of the developed image. Three curves 4*a*, 4*b* and 4*c* are characteristic curves of the above-mentioned film as treated in accordance with the process of FIG. 3. The abscissa and ordinate represent relative logarithmic exposure of image at the step B and the reflection density of the developed image in the exposed area, respectively. The curves 4*a*, 4*b* and 4*c* were obtained when the light intensity in the step C where 1 mW/cm², 20 mW/cm² and 1000 mW/cm², respectively. It will be apparent that the reflection density of the colored area is greatly dependent on the light intensity as well as on exposure at the step B. According to the invention, the flood light exposure in the step C should range from 1.0 millijoule/cm² to 1000 millijoules/cm² with a light intensity of at least 1.0 mW/cm². The principal purpose of the step C is the intensification of the latent image formed in the light-struck area by the imagewise exposure.

The heating step D for development of the intensified latent image may be carried out in the well known manner. It will be convenient to employ the same temperature as that for the preheating. The heating time may be determined depending on the kind of heater and/or the physical conditions of the film.

The second flood light exposure is carried out to accomplish a complete polymerization of N-vinylcarbazole in the non-light-struck area. The exposure is preferably made to an ordinary fluorescent lamp having a characteristic wavelength range of 3600 to 7000 A. After the second flood light exposure, a small amount of colorless photopolymer was extracted from the brightest area of the obtained negative image. The molecular weight of the extracted polymer was measured by means of a viscometer, and the determined values were in a range from 6000 to 7000. The formation of such a high polymer proves that the step E has a remarkable effect on the photopolymerization in the unexposed area.

The invention will be more fully understood from the following examples.

EXAMPLE 1

A photosensitive emulsion was prepared by the following well known procedures.

Preliminarily, 10 g of refined N-vinylcarbazole was mixed with 6 mg of 4-(p-dimethylaminostyryl)-quinoline as a sensitizer, and 5 g of refined carbon tetrabromide was dissolved in 5 ml of acetone. A gelatin sol was prepared by swelling 20g of gelatin with water and then raising the water temperature to about 60° C followed by stirring. The initially prepared mixture and solution were added to the gelatin sol with vigorous stirring, so that N-vinylcarbazole, 4-(p-dimethylaminostyryl)-quinoline and carbon tetrabromide were dispersed in the gelatin in discrete fine particle form.

The emulsion was applied onto baryta paper to form a uniform emulsion layer thereon. The emulsion-coated paper was dried in a dark chamber by subjecting it to a hot air stream of about 80° C for a period of about 3 minutes. After cooled to room temperature the dried emulsion layer gave so high a surface resistivity as to be beyond the range of an ordinary insulation tester.

Figure 5:
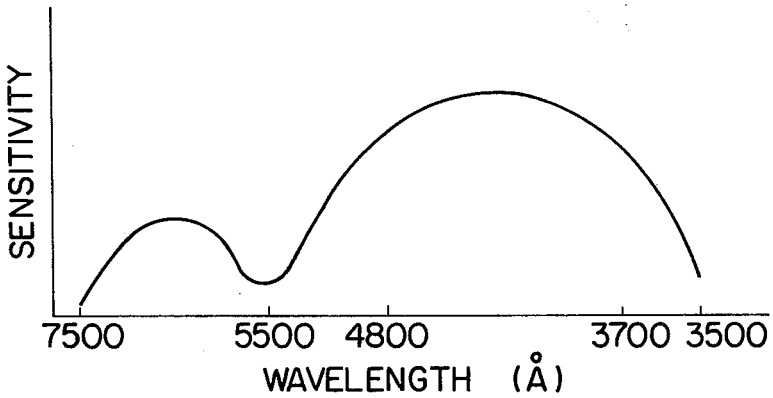
FIG. 5 is a graph showing a spectral sensitivity of a photosensitive film to be used for the process of FIG. 3.

It is to be particularly noted that the drying renders the emulsion layer practicably photosensitive due to, presumably, formation of charge-transfer complexes of contact type from the particles of N-vinylcarbazole and those of carbon tetrabromide, the former acting as donors and the latter as acceptors. FIG. 5 shows a wedge spectrum and the dried emulsion layer, in which the main band is located in the neighborhood of 4400 A and a sub-band is observed around 6000 A. This spectrum is quite different from that observed for a solution of the same components in ethylene dichloride. The spectrum of FIG. 5, therefore, appears to be characteristic of this composition in a solid state.

The thus prepared photosensitive paper was used throughout the subsequent Examples except where otherwise mentioned.

Figure 6:
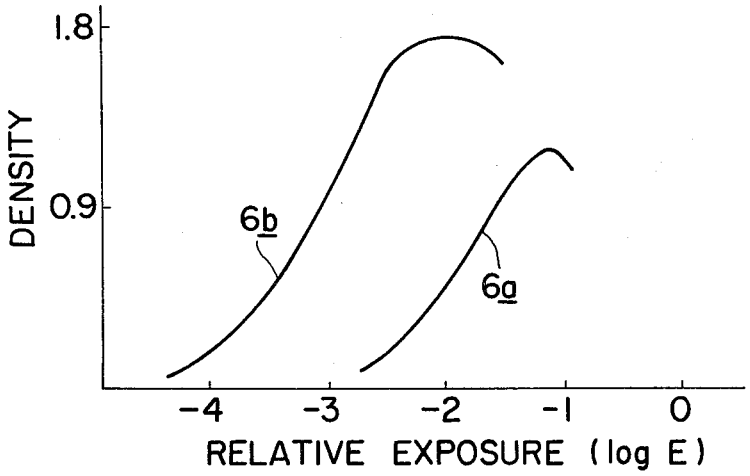
FIG. 6 is a graph showing the effect of the step A of the process of FIG. 3 on the characteristic curve of a photosensitive film.

The dried and cooled photosensitive paper was placed in a dark chamber maintained at 100° C for a period of up to 60 seconds to accomplish the step A of FIG. 3. With the lapse of time the characteristic curve was caused to drift toward the lower exposure side and the peak value rised to a higher level. Such a transition is shown in FIG. 6, in which the curve 6*a* was obtained for the photosensitive paper dried but thermally untreated before imagewise, while the curve 6*b* was for the paper sufficiently preheated. Next, the preheated paper was imagewisely exposed to a 500-watt xenon discharge tube through a negative film for 1/100 second. The paper was then subjected to a first flood light exposure by exposing it to the same light source through a Toshiba V-054 filter which cuts off wavelengths below 5400 A. The reflection density of a final image depends on this flood light exposure and a minimum light intensity of 1 mW/cm$^2$ was required to obtain a stable color or image. Then the paper was heated at 100° C for 30 seconds to develop the image. Finally the paper was exposed to radiation from an ordinary fluorescent lamp at a light intensity of 50 lux for 10 seconds. The image thus produced on the paper was a negative with regard to the projected negative film and the darkest area thereof had a reflection density of 1.8 while the brighest area had the value of 0.15.

Figure 7:
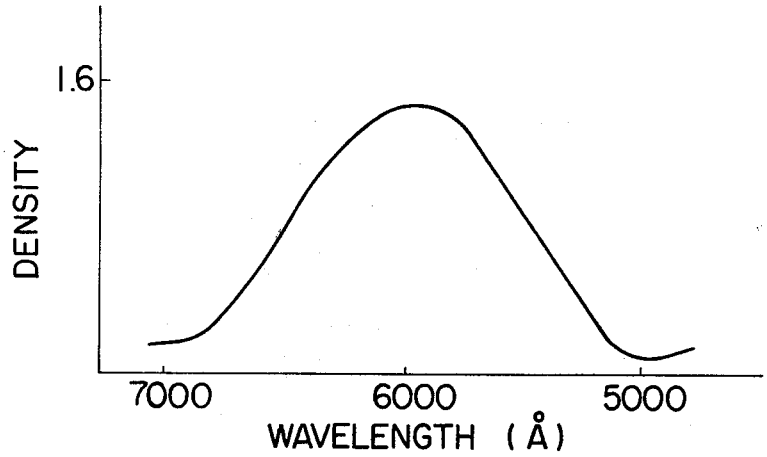
FIG. 7 is a graph showing the relationship between the wavelength employed in the step C of the process of FIG. 3 and optical density of a produced image.

An experiment was carried out to examine the relationship between the wavelength of light at the step C and the reflection density of the final image, and the result is presented in FIG. 7 wherein the abscissa and ordinate represent the wavelength and the reflection density, respectively. The preheated paper was initially exposed to the light of the main band in FIG. 5 and then was subjected to the first flood light exposure by means of a spectrophotometer. Accordingly, the irradiating light was dispersed optically, and the curve 7 was obtained, which curve is a kind of wedge spectrum representing the characteristic dependence of the reflection density on the wavelength. As seen from the curve 7, it was found that the preferable wavelength range for the first flood light exposure was between 5000 and 7000 A.

EXAMPLE 2

An electric heater was used to carry out the preheating step A and the development heating step D. The heater had an aluminum guide member heated by bar heating elements and a roller covered with glass wool and arranged to rotate keeping in contact with the guide surface. Both sides of the photosensitive paper of Example 1 were heated while being inserted between the guide and roller and passing along the guide surface. The temperature and time for the respective heating steps were regulated by controlling the voltage on the heating elements and the rotation speed of the roller, respectively. It was practically convenient to perform the two steps A and D under the same condition.

Figure 8:
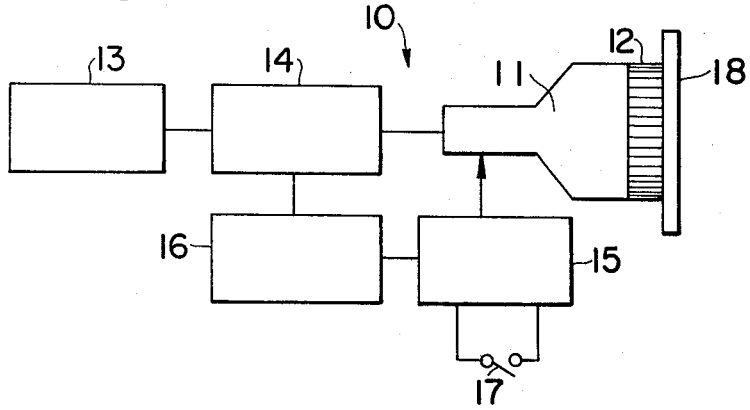
FIG. 8 is a diagram of an image recording system.

Reference is now made to FIG. 8 in which is shown a television image recording system generally indicated by reference numeral 10. The recording system 10 comprises a cathode ray tube 11 having a fiber optics faceplate 12 the phosphor coating thereon being of RCA type P11. The spectral sensitivity of this phosphor material lies in a range between 2500 and 5000 A with a peak at about 4500 A which is within the principal band of the spectrum of FIG. 5, and the 10 percent decay time of phosphorescence is as long as 22 microseconds. The cathode ray tube 11 with this type of phosphor, therefore, is an object well suitable for application of the photosensitive paper of Example 1. The recording system 10 further comprises a picture signal source 13, a video amplifier 14, a one-frame gate circuit 15 associated with a synchronizing pulse separator 16 and a switch 17 for energizing the gate circuit 15 to allow a fraction of the picture signal corresponding to just one frame of picture to be scanned on the faceplate 12. The cathode ray tube 11 was normally isolated from the signal source 13, and the picture was monitoring through a separate receiver (not shown).

The photosensitive paper 18 of Example 1 was preheated at 60° C for 60 seconds and then was placed in direct contact with the faceplate 12. When a desired picture appeared on the separate receiver the switch 17 was closed to cause the gate circuit 15 to act to display one-frame of the picture on the faceplate 12, so that the paper 18 was exposed to the displayed picture. The paper 18 was removed from the faceplate 12 and was exposed to a flood light radiation from a 100-watt tungsten lamp with a V-054 filter at a distance of 30 mm therefrom and for a period of 3 seconds. Then the paper 18 was heated at 60° C for 60 seconds followed by the final flood light exposure to the fluorescent lamp of Example 1 with an intensity of 500 lux for 1 second. In the cathode ray tube 11, both the polarity of the picture signal and the scanning direction were reversed to the normal conditions, so that the negative image produced on the paper 18 was a positive of the monitored picture. The reflection densities of the obtained picture in the darkest area and brightest area were 1.78 and 0.12, respectively. When the preheating step was omitted, the brightest area or the background area showed a reflection density of 0.28.

The fiber optics faceplate 12 was employed in the above and the following Examples for its advantage over a glass screen to give a sharply defined image exposure.

EXAMPLE 3

The photosensitive paper was preheated at 80°C for 3 seconds and was exposed to a television picture in the same manner as in Example 2. Four 500-watt xenon tubes with a Kodak Sheeting Orange were used in the first flood light exposure. The paper was exposed to the light source for 0.5 second at such a distance therefrom that the illumination intensity thereon was 50,000 lux, which value corresponds to about 200 mW/cm$^2$ of power density. After that the paper was heated at 80° C for 3 seconds and was subjected to the second flood light exposure under the condition of Example 2. The reflection intensities of the darkest and brighest areas were 1.6 and 0.18, respectively.

EXAMPLE 4

A charge of 6 mg of 4-phenylazodiphenylamine was added to the emulsion of Example 1. Example 2 was repeated except that the heating conditions were 120° C, 5 seconds, that the first flood light exposure was for 1 second and that the final flood light exposure was carried out under the conditions of 100 lux and 5 seconds. The resulting negative image was black colored and had a contrast comparable to that in Example 2.

Remarkable effects of the preheating according to the invention on the sensitivity of the dry emulsion layer and on the background density of the produced picture will have been understood from the foregoing Examples and FIG. 6. The preheating, however, brings about further advantageous phenomena, which will be hereinafter described as well as a brief consideration of the reason for or origin of such effects and phenomena.

Figure 9:
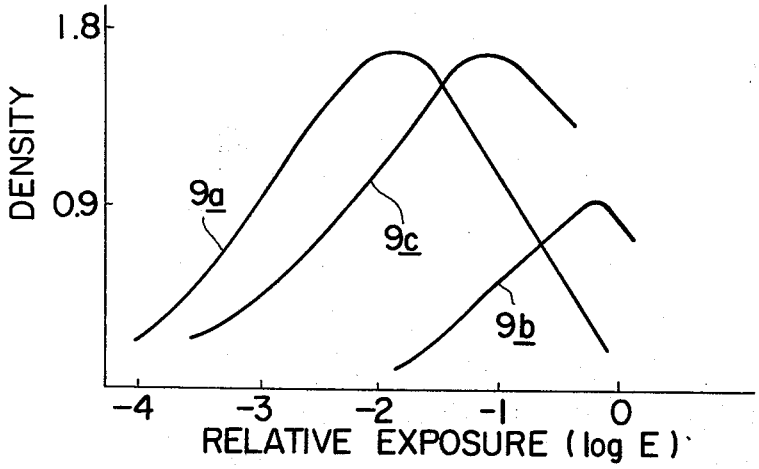
FIG. 9 is characteristic curves of a photosensitive film showing the effect of the step A of the process of FIG. 3.

We have discovered that the preheating causes films deteriorated through a long preservation to revive to the original sensitivity level. Referring to FIG. 9, the curve 9*a* is a characteristic curve of a film coated with the emulsion of Example 1 obtained by a measurement just after the preparation. The same film gave the curve 9*b* when measured after a three months preservation at room temperature, but the curve 9*c* was obtained when the preserved film was preheated according to the invention prior to the exposure and heating steps for measurement. The sensitivity-reviving effect of the preheating will be apparent from a comparison of the curve 9*c* with the curves 9*a* and 9*b*, and the effect is of a practical importance since the film deteriorates inevitably through preservation by gradual polymerization and/or hydrolysis of N-vinylcarbazole, which are induced even in the dark.

As is afore-mentioned, the preheating leads to reduction of the background density or the fog density of the developed film. It is practically impossible to eliminate all the causes of the fog formation since the fog nuclei are considered to be formed chemically, mechanically, thermally and/or optically throughout the procedures for the preparation, preservations and/or photographic processing of the film. It is accordingly a great advantage of the invention that a sharp reduction in the fog density is attained by the addition of a quite simple step of preheating.

From a slightly different point of view, the preheating may have a certain effect on weak latent images; in other words, weak latent images may be destroyed by heat.

Figure 10:
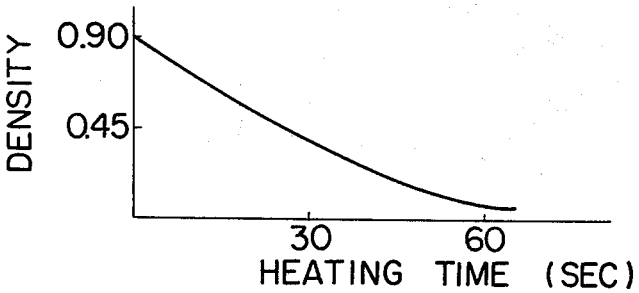
FIG. 10 is a graph showing the relationship between an experimental heating time and the optical density of the processed film.

An experiment was performed to ascertain this assumption, in which experiment the sequence of the step A to step B of FIG. 3 was reversed that is, the film was processed in the sequence of the steps B-A-C-D-E. The film was initially exposed for 1/60 second to a 500-watt xenon discharge lamp at a distance of 60 cm and then was heated at 100° C prior to the step C. The experiment revealed that the reflection density of the final image decreased as the heating time at the step A or the second step in the experimental process was prolonged. The experimental result is presented in FIG. 10, and the above assumption was verified.

Figure 11:
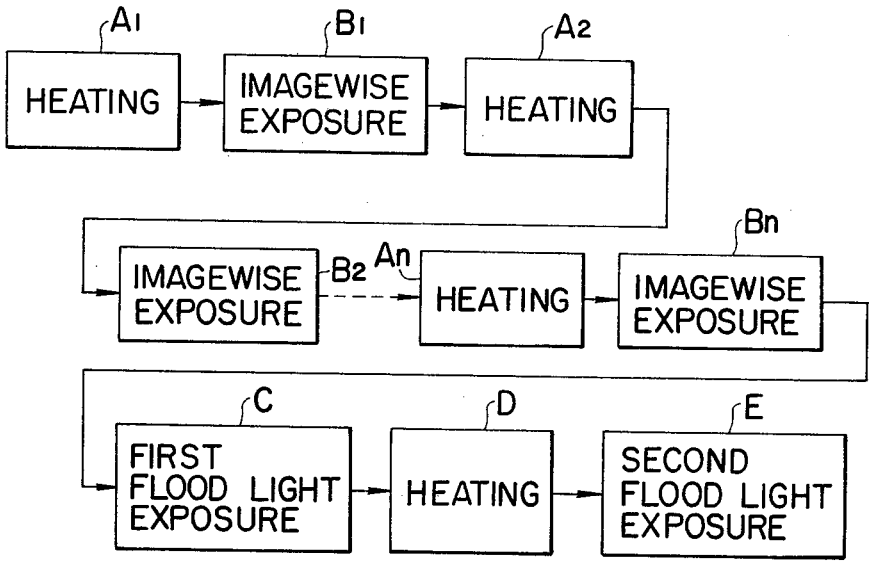
FIG. 11 is a diagram showing a negative-working photographic process as a second preferred embodiment of the invention.

Based on this discovery we provide a unique modification of the process of FIG. 3. Referring now to FIG. 11, the preheated (at the $A_1$) film is again heated sufficiently at the same temperature (step $A_2$) after the step $B_1$ of a first imagewise exposure if the projected image was found inappropriate or unnecessary. Then the same film can be subjected to a next imagewise exposure at the step $E_2$. The exposure steps $B_n$ and the heating steps $A_n$ may be repeated until a desired image is projected on the film at the *n* th exposure. Thereafter the film is processed through the steps C, D and E in the same manner as in the process of FIG. 3 to develop only the lastly given image thereon. Such a unique behavior of the latent images has never been experienced for a silver halide system and is characteristic of the emulsion employed in the present invention. The process of FIG. 11 will be hereinafter illustrated by a few more Examples.

EXAMPLE 5

The photosensitive paper of Example 1 was preheated at 100° C for 30 seconds. The preheated paper was brought into close contact with a first negative film and was exposed for 1/500 second to radiation from a 500-watt xenon lamp placed 1 m away from the paper. The exposed paper was again heated at 100° C for 30 seconds and was subjected to another imagewise exposure under the above conditions except that the negative film was replaced with a second one. Then the paper was exposed to a flood light from a 500-watt tungsten lamps interposing a V-054 filter followed by heating at 100° C. After the second flood light exposure to a fluorescent lamp, a clear positive image of the second negative film was produced on the paper. The reflection density values were 0.80 in the darkest area and 0.13 in the brightest.

EXAMPLE 6

The image recording system of Example 2 was used, and the conditions for the steps of preheating, first flood light exposure, development heating and second flood light exposure were similar to those in Example 5. The photosensitive paper was kept on the faceplate until ten frames of picture signals were intermittently, one frame at a time, displayed on the faceplate. After heated at 100° C for 30 seconds the paper was again brought into contact with the faceplate to be exposed to another one-frame picture display. The subsequent photographic processing produced a negative image of the finally displayed picture on the paper giving no race of the initial ten frames of pictures. The darkest and brightest areas had the densities of b 1.10 and 0.12, respectively.

EXAMPLE 7

This Example was identical with Example 6 both in the apparatus and in the steps for development and fixing, but two different television pictures were recorded each partly on a sheet of photosensitive paper in this Example.

The preheated paper was placed on the faceplate of the cathode ray tube and was exposed to one frame of a first picture display. A sheet of thin black paper was brought into contact with the rear surface of the photosensitive paper on the faceplate to cover the left side half of the rear surface. Then the entire rear surface was exposed to a strong red light. Since the baryta paper was about 150 microns thick, the paper allowed the red light to pass therethrough at the right side thereof. Accordingly, the latent images on the right side were intensified by the red light while those on the left side were destroyed by heat resulting from the red light absorption of the black paper. After that the entire rear surface of the photosensitive paper was closely covered with the black paper and was again exposed to the strong red light, so that the emulsion layer was heated in its entirety by the light energy absorbed in the black paper. The heating caused the right side latent images to be developed and the left side latent imates to completely disappear. At the same time the emulsion layer on the left side was substantially preheated by way of preparation for the following imagewise exposure.

After irradiation of a sufficient amount of the red light, one frame of a second picture was displayed on the faceplate so that the latent image thereof may be formed in the emulsion layer on the left side. On the right side, the colored area had lost the photosensitivity, but the background area allowed the latent image of the second picture to be formed therein. Next, only the right side half of the rear surface was closely covered with the black paper and the entire rear surface was once more exposed to the strong red light to intensify the left side latent image and to extinguish the right side one.

The photosensitive paper was removed from the faceplate to be processed in accordance with the steps D and E of FIG. 11. The processed paper gave the partial images of the first and second pictures on the right side and left halves thereof, respectively, in a sharp distinction.

The advantages of a process according to the invention and particularly those derived from the step of preheating will have been fully understood. The cause of these surprising effects of the preheating will now be considered.

Figure 12:
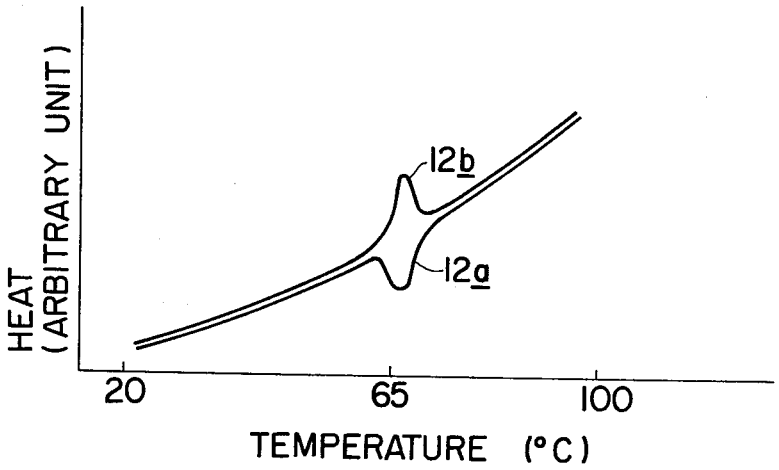
FIG. 12 is a graph showing the results of thermoanalysis for a photosensitive film to be used for the process of FIG. 3.

The softening of the emulsion layer due to the heating may facilitate the formation of charge-transfer complexes, resulting in an increased photosensitivity. The elevated temperature may accelerate the deactivation of charge-transfer complexes in a weakly excited states, which may act as fog-nuclei. We have contemplated, however, the melting points of the main components of the photosensitive composition herein employed. N-vinylcarbazole and carbon tetrabromide melt at about 65° C and about 92° C respectively, which values are much lower than the melting point of silver bromide, 434° C. The main reason for the effects of the preheating presumably resides in the low melting point of N-vinylcarbazole. A photosensitive paper prepared in accordance with Example 1 was subjected to thermoanalysis by means of a differential scanning calorimeter and the results are presented in FIG. 12. The abscissa represents temperature and the ordinate the amount of heat absorbed into or liberated from the paper. The curve 12*a* was obtained when the paper temperature was gradually increased and the curve 12*b* was obtained when the once heated paper was cooled. These curves show clearly that melting and solidification or recrystallization of N-vinylcarbazole take place in the emulsion layer when the paper is once heated.

Recrystallization of N-vinylcarbazole in the dry emulsion layer seems to give a clear answer to the origin of the effects of the preheating particularly on extinction of latent images and fog nuclei. N-vinylcarbazole in excited states will be deactivated by melting. In other words, the particles of the compound lose memories borne as latent images or fog nuclei. When the melted N-vinylcarbazole recrystallizes, poly-N-vinylcarbazole and/or products of hydrolysis of the monomer will be seggregated from pure monomer of N-vinylcarbazole, resulting in formation of charge-transfer complexes of pure N-vinylcarbazole and pure carbon tetrabromide in the emulsion layer on the film. The preheating of the film or the recrystallization of N-vinylcarbazole can be repeated many times so long as no component of the composition volatilizes out by heating. The effects of the preheating remains until the recrystallized N-vinylcarbazole again undergoes polymerization or hydrolysis to some extent.

The effects of the preheating particularly on the sensitivity are observed even when the preheated film is processed after cooled to room temperature. A test revealed that films preserved in a dark and dry chamber at 20°C for two weeks after the preheating gave a sensitivity comparable with that observed just after the preheating. Consequently, the effects of the preheating on sensitivity is considered to last for a period of up to two weeks.

What is claimed is:

1. A dry working photographic process of producing a negative image on a photographic film coated with a photosensitive composition comprising N-vinylcarbazole, carbon tetrabromide and 4-(p-dimethylaminostyryl)-quinoline, the composition being dispersed in gelatin in discrete fine particle form, said film being dried and cooled to room temperature subsequent to coating with said composition, the process comprising the steps of:

a. heating said film prior to an imagewise exposure at 60° to 120° C. for 1 to 60 seconds to sensitize said film and to prevent formation of fog in unexposed areas of said film during subsequent steps;

b. imagewisely exposing said film to radiation in the wavelength range of 2500 to 5000 A to produce latent images in the exposed areas;

c. exposing said film to a first flood light radiation in the wavelength range of 5000 to 7000 A with a total energy of 1 to 1000 millijoules/cm$^2$ with a light intensity of at least 1 mW/cm$^2$ to intensify said latent images;

d. heating said film at 60° to 120° C. to develop said latent image into a colored image; and e. exposing said film to a second flood light radiation in the wavelength range of 3600 to 7000 A with an illumination intensity of 50 to 500 lux for at least 1 second to cause said N-vinylcarbazole in the unexposed areas to photopolymerize to give a colorless polymer.

2. A process as claimed in claim 1 further comprising a step (f) of heating said film at 60° to 120° C for 1 to 60 seconds between said steps (b) and (c) to extinguish said latent images when said latent images are inappropriate to be developed, said film thereafter being again subjected to said step (b).

3. A process as claimed in claim 2, in which said steps (b) and (f) are repeated a plurality of times prior to said step (c) until a desired image is exposed on said film.

4. A dry working photographic process of producing a negative image of a picture displayed on a screen of a cathode ray tube on a film coated with a photosensitive composition comprising N-vinylcarbazole, carbon tetrabromide and 4-(p-dimethylaminostyryl)-quinoline, the composition being dispersed in gelatin in discrete fine particle form, said film being dried and cooled to room temperature subsequent to coating with said composition, the process comprising the steps of:

a. heating said film at 60° to 120° C. for 1 to 60 seconds;

b. placing said film on said faceplate;

c. exposing said film placed on said faceplate to a first picture displayed on said faceplate to produce a latent image, said first picture radiating light including wavelengths between 2500 to 5000 A;

d. determining the necessity of said first picture;

e. removing said film from said faceplate;

f. heating said film at 60° to 120° C. for 1 to 60 seconds to extinguish said latent image when said first picture is unnecessary;

g. repeating said steps (b), (c), (d) and (e) except that a second picture is displayed in said step (c), said second picture radiating the same light as first picture;

h. exposing said film to a first flood light radiation in the wavelength range of 5000 to 7000 A total exposure of 1 to 1000 millijoules/cm$^2$ with a light intensity of at least 1 mW/cm$^2$ when said second picture is necessary to intensify the latent image of said second picture;

i. heating said film at 60° to 120° C. to develop the intensified latent image into a colored image; and j. exposing said film to a second flood light radiation in the wavelength range of 3600 to 7000 A with an illumination intensity of 50 to 500 lux for at least one second to cause said N-vinylcarbazole in the unexposed areas to photopolymerize to give a colorless polymer.

5. A process as claimed in claim 4, in which said steps (b), (c), (d), (e) and (f) are repeated at least three times.

6. A dry working photographic process of producing a first negative image of at least a portion of a first original image and a second negative image of at least a portion of a second original image on a first area and a second area, respectively, of one photographic film coated with a photosensitive composition comprising N-vinylcarbazole, carbon tetrabromide and 4-(p-dimethylaminostyryl)-quinoline, the composition being dispersed in gelatin in discrete fine particle form, said film being dried and cooled to room temperature subsequent to coating with said composition, the process comprising the steps of:

a. heating said film at 60° to 120° C. for 1 to 60 seconds;

b. imagewisely exposing said film with said first original image by radiation in the wavelength range of 2500 to 5000 A to produce a latent image in the exposed areas;

c. covering said second area of said film with a light-impermeable sheet;

d. exposing said film to a first flood light radiation in the wavelength range of 5000 to 7000 A with a total energy of 1 to 1000 millijoules/cm$^2$ with a light intensity of at least 1mW/cm$^2$ to intensify said latent image in said first area;

e. heating said film at 60° to 120° C. for 1 to 60 seconds to develop said latent image on said first area into a colored image and to extinguish the latent image in said second area;

f. imagewisely exposing said film with said second original image by radiation in the wavelength range of 2500 to 5000 A to produce another latent image in the exposed areas after removal of said sheet therefrom;

g. covering said first area with said sheet;

h. repeating said step (d) to intensify said another latent image in said second area;

i. heating said film at 60° to 120° C. for 1 to 60 seconds to develop said another latent image on said second area into a colored image and to extinguish said latent image in said first area; and j. exposing said film to a second flood light radiation in the wavelength range of 3600 to 7000 A with an illumination intensity of 50 to 500 lux for at least one second to cause said vinylcarbazole in the unexposed areas to photopolymerize to give a colorless polymer after removal of said sheet.

7. A process as claimed in claim 6, in which said first and second original images are two separate pictures displayed on a cathode ray tube, said light-impermeable sheet being a heat-absorbing black sheet, which sheet being arranged to closely cover the rear surfaces of said second area and said first area in said steps (c) and (g), respectively, said step (e) being carried out simultaneously with said step (d) by means of said first flood light.

* * * * *